United States Patent [19]

Chien-Chun

[11] 4,345,223

[45] Aug. 17, 1982

[54] FUSELESS SAFETY MAGNETIC PLUG

[76] Inventor: Yu Chien-Chun, 730 Yen-ping Rd., Hsin-chu City, Taiwan

[21] Appl. No.: 201,529

[22] Filed: Oct. 28, 1980

[51] Int. Cl.[3] ..... H01H 77/00

[52] U.S. Cl. ..... 335/6; 335/202; 337/198; 339/147 P

[58] Field of Search ..... 335/2, 6, 18, 27, 202; 337/198; 339/147 P; 361/45

[56] References Cited

U.S. PATENT DOCUMENTS

| | | | |
|---|---|---|---|
| 3,247,339 | 4/1966 | Miller | 335/6 X |
| 3,761,774 | 9/1973 | Laughinghouse et al. | 361/45 |
| 4,079,344 | 3/1978 | Lauben et al. | 361/45 X |
| 4,285,022 | 8/1981 | Lewiner et al. | 361/45 |

*Primary Examiner*—William M. Shoop
*Attorney, Agent, or Firm*—Lackenbach, Siegel, Marzullo, Presta & Aronson

[57] ABSTRACT

A fuseless safety magnetic plug has a housing structure divided into a base and a cover, a pair of wire coupling devices, a magnetic device for preventing the plug from overloading, and two prongs for making electrical connections. The wire coupling devices require no instrument or disassembly of the plug for terminating a power cord because the connection can be made simply by inserting ends of the cord into the wire coupling devices from the outside of the plug. The magnetic device comprising a pair of electromagnetic members, a cam mechanism, a plurality of movable plates, a metal stud, a reverse spring, and a load discharging bolt, is mounted within the housing structure for controlling the current flowing through channels thereof and for breaking the circuit if any one of the channels is overloaded, while it resumes normal conduction by pressing down the load discharging bolt over the cover after the trouble is removed therefrom. Moreover, this plug is available for various electrical appliances by setting a current adjusting device thereat or by providing it with a rear socket means therein.

5 Claims, 2 Drawing Figures

FUSELESS SAFETY MAGNETIC PLUG

BACKGROUND OF THE INVENTION

1. Field of the Invention

This invention relates to a fuseless safety magnetic plug which includes a housing structure, a pair of wire coupling devices, a magnetic device, and a pair of prongs, and is suitable for various current loads and convenient for wire connection.

2. Description of the Prior Art

Two types of conventional plugs are in common use: one type utilizes fuse, the other does not. However, no matter what type of plug they belong to, the common defect is that when making wire connection, disassembly of the housing structure has to be done in order to terminate the wire ends of the cord on the prongs respectively either through screws attached thereof or by soldering which results in much inconvenience to the users and posts difficulties to those, especially female users, not familiar with electrical operation. On the other hand, some of the known plugs are made by supersonic machine through molding and thermal sealing operation with the power cord connected thereto. In case of trouble during use, this kind of plug cannot be repaired and used again except for replacement. Moreover, as this type of plug has no fuse installed, it posts a certain danger to the equipment connected therewith resulting in not keeping with the safety requirement in the modern society.

Regarding the plug with fuse installed therein, it contains either a glass-sealed fuse or a soldered fuse on the prongs. When the fuse is burnt out because of overloading, if it belongs to the glass-sealed type plug, replacement can be made but it costs more; if it belongs to the soldered-fuse type plug, replacement can hardly be done by the normal people.

Furthermore, a plug with fuse is generally not adaptable to various kinds of electrical appliances because different current requires different fuses. For example, the current required for an electrical stove is far different from that required for a desk lamp. Therefore, no fuse is suitable for various electrical appliances.

SUMMARY OF THE INVENTION

The present invention provides a novel and improved magnetic plug completely eleminating the defects of the paior art and being adaptable to various kinds of electrical appliances.

The primary object of this invention is to provide a safety plug by using a magnetic device instead of fuse to protect the equipment connected therewith from overloading simply by varying its magnetic field without affecting its internal construction.

Another object of this invention is to provide a magnetic plug characteristic of having a current adjusting device which is applicable to any electrical appliances without affecting its safety.

Still another object of this invention is to provide a magnetic plug having a pair of wire coupling devices with which the termination of the power cord can be done simply by inserting the wire ends of the cord into the wire coupling devices from the outside of the housing structure.

These and other objects of the invention will become apparent to those skilled in the art from the following detailed description of the preferred embodiments when read with reference to the accompanying drawings.

DETAILED DESCRIPTION OF THE PREFERRED EMBODIMENTS

Figure 1:
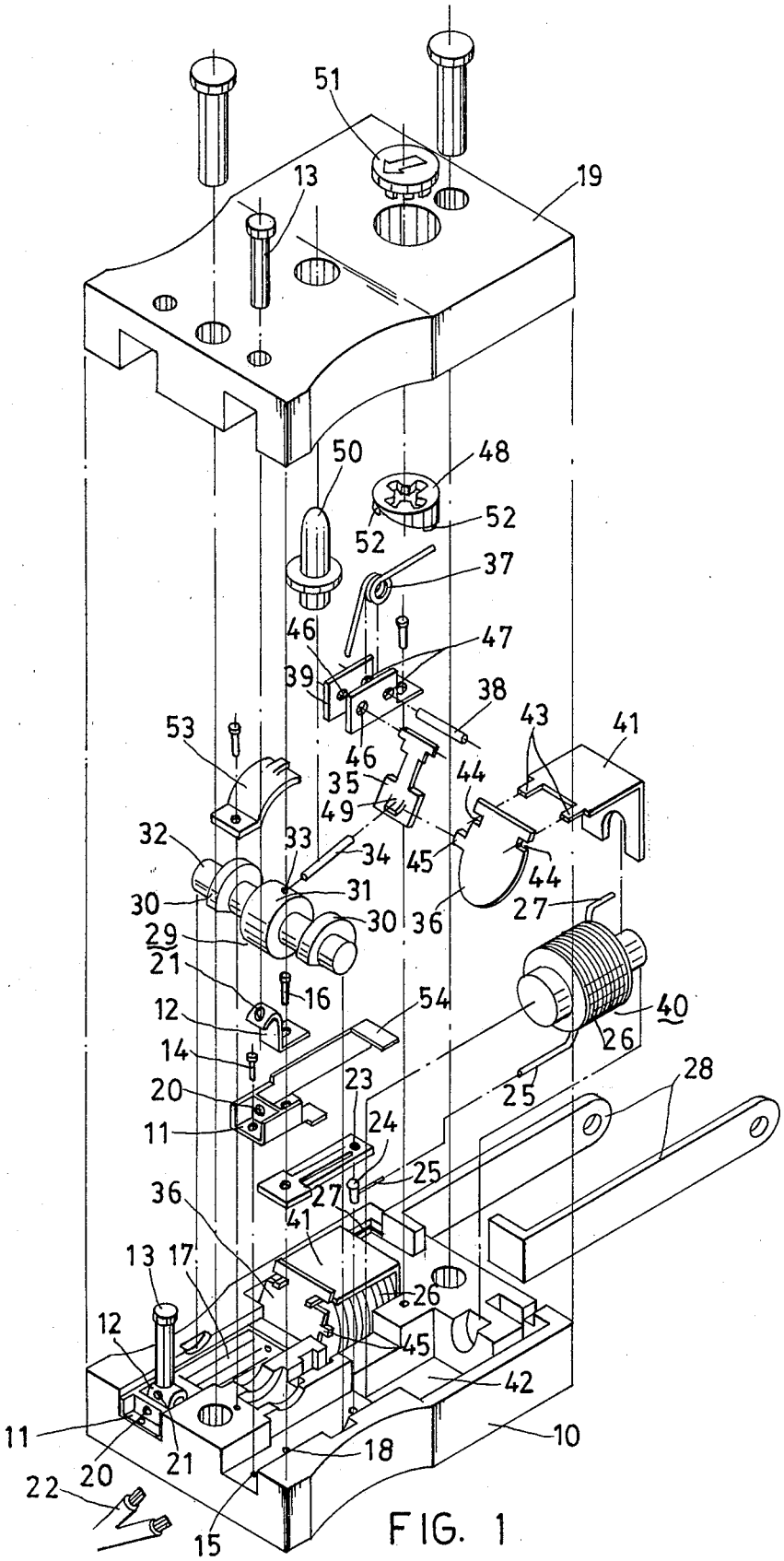
FIG. 1 is an exploded view of this invention.

Referring to FIG. 1, a safety magnetic plug of this invention has a base 10 and a cover 19. A wire coupling device made of a wire insertion base 11, a connecting plate 12 and a wire locking bolt 13 is fastened on the base 10 by a screw 14, a hole 21 on the connecting plate 12 being directly laid above a wire inserting orifice 20 on a cross member of the wire insertion base 11. Meanwhile a spring plate 17 haveing a platinoid protrusion 23 at one end is placed within the wire insertion base 11 and secured to the base 10 through a screw hole 18 thereof by a fixing screw 16. When the cover 19 is connected to the base 10, the head of the wire locking bolt 13 protrudes over the external surface of the cover 19 while the end of the locking bolt 13 is in touch with the top of the wire connecting plate 12. When making wire termination, an operator may press down the head of the wire locking bolt 13 to propel the connecting plate 12 downward until the hole 21 is in axial line with the wire inserting orifice 20, insert an end of a cord 22 into the hole 21 through the wire inserting orifice 20 and release the wire locking bolt 13, then the terminal of the cord 22 will be firmly seized in the holes 20 and 21 thereof.

Down below the platinoid protrusion 23 of the spring plate 17, a platinoid contact pin 24 connects a conductor 25 to a solenoid 26 which in turn connects to a prong 28 by a further conductor 27 thus constituting an electrical channel therein. As shown in the drawing, a cam mechanism 29 having a cam 30 on both ends of an axle 32 and a control wheel 31 in the middle thereof is provided with a cover 53 for preventing it from skipping, and is installed on the base 10 with the flat surface of both said cams 30 facing the spring plate 17. On the central surface of the control wheel 31 a metal stud 34 is installed at an opening 33 thereon for controlling the movement of the cam mechanism 29. When a downward pressure is applied to the head of the metal stud 34, the cams 30 on both ends of the cam mechanism 29 will follow to turn. Owing to the radius movement of the cams 30, the spring plate 17 will be propelled downward making the platinoid protrusion 23 contact the platinoid contact pin 24 so that a further electrical channel from the power cord 22 to the prong 28 is constituted accordingly.

A magnetic device 40 with a cover 41 is installed in a communication space 42 on the base 10, and the cover 41 having two protrusions 43 extending along the front edge thereof is properly and loosely engaged with two notches 44 on the upper edge of a magnetic plate 36 to form a movable piece thereof. The magnetic plate 36 has on its inner side a lug 45 which is used for operating with a movable plate 35 when the magnetic plate 36 is attracted by the magnetic device 40. A fixing frame 39 is mounted on the base 10 by a rivet, and the movable plate 35 is pivotally connected with the fixing frame 39 with a pin 38 coupled with a reverse spring 37 and inserted into a hole 47 thereon. One end of the reverse spring 37 is in touch with the movable plate 35 and the other end thereof is pressed down below the slant surface of an adjusting knob 48 so as to keep the movable plate 35 in an inclined position. The movable plate 35 has a click 49 on the middle part for receiving the downward pressure applied by the metal stud 34 and is locked in position to keep the platinoid protrusion 23 in contact with the platinoid contacting pin 24 and to form a conducting path thereof. When the current flows through the solenoid 26, magnetic force will be produced thereby attracting the magnetic plate 36 which will in turn operate the movable plate 35 by the lug 45. On the other hand, owing to the fact that the movable plate 35 is under the influence of the tension applied by the reverse spring 37, the attracting force produced by the magnetic device 40 must be greater than the pressure from the reverse spring 37 in order to operate the movable plate 35. Therefore, in this invention the movable plate can be operated only when the load limit exceeds, e.g. when the current is great enough to produce strong magnetic force to operate the movable plate 35, the metal stud 34 will be separated from the click 49 of the movable plate 35, and turn the cam mechanism 29 causing the flat surface of the cam 30 to face the spring plate 17 so that once the pressure applied to the spring plate 17 by the cams 30 is released, the spring plate 17 will move back upward until it impinges against a stop block 54 at the end of the wire insertion base 11. As a result, the circuit is automatically broken so as to prevent it from overloading. Right above the metal stud 34, a load discharging bolt 50 is installed through the cover 19 with its head protruding from the external surface of the cover 19. After the circuit is automatically broken to open due to overloading, and the check or repair of the appliance connected thereto is done, the operator may press down the load discharging bolt 50 so as to make the metal stud 34 move downward and the movable plate 35 will be engaged with the click 49 again. In the meantime as the metal stud 34 is pressed down, the cams 30 will also make a turn and propel the spring plate 17 down so that the platinoid protrusion 23 on the spring plate 17 contacts the platinoid contacting pin 24 for resuming normal curcuit function.

An upper adjusting knob 51 is engaged to a lower adjusting knob 48 through a cross-shape coupling arrangement thereat. The bottom of the lower adjusting knob 48 has a slant surface with two stop blocks 52 provided as adjusting limits for current setting. Since one end of the reverse spring 37 is pressed down by the lower adjusting knob 48 on the slant surface, tension of the reverse spring 37 is applied to the movable plate 35 through another end of the reverse spring 37. This tension specially designed by the invention is just equal to the magnetic force produced by the normal current. When the magnetic force produced thereat is greater than the tension, the movable plate 35 will immediately move inward making the metal stud 34 disengage itself from the click 49 on the movable plate 35 and thus break the circuit. As soon as the circuit is open, the magnetic device 40 is out of function and the tension of the reverse spring will make the movable plate 35 back to its normal position ready for next circuit connection, eliminating the drawback of replacing fuses as required in the conventional plug. More particularly, as different appliances require different fuses for their different given current, this invention provides the lower adjusting knob 48 with a slant surface on the bottom matching with an upper adjusting knob 51 so as to make a proper adjustment for setting different tension of the reverse spring 37 to be applied to the movable plate 35 corresponding to the different current requirement of the appliances connected thereto. The stop blocks 52 at the bottom surface of the lower adjusting knob 48 can set the limit to both the maximum and the minimum current requirement for various appliances. For accurate adjustment, proper markings for various current requirement can be made either on the top surface of the upper adjusting knob 51 or on the external surface of the cover 19.

Figure 2:
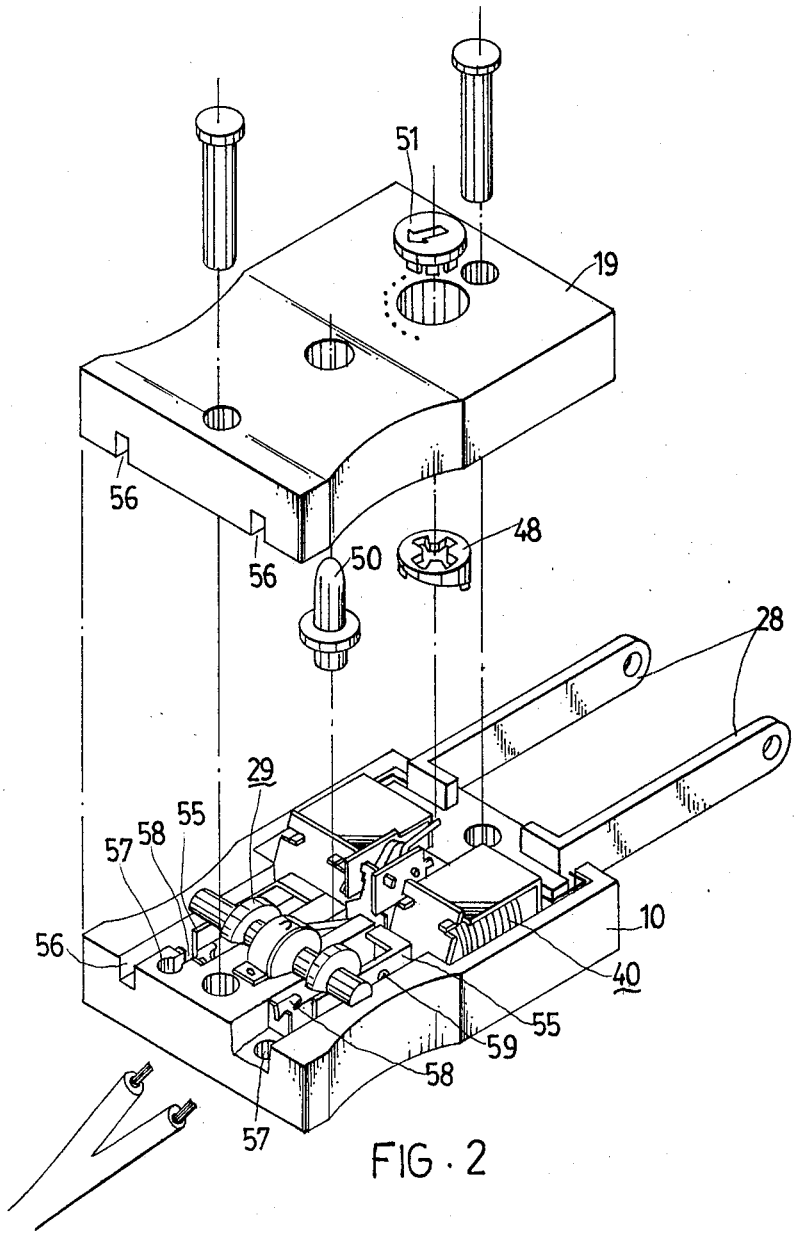
FIG. 2 is a partially exploded view of this invention with a rear socket.

FIG. 2 is an another embodiment of this invention functioning as a safety plug-adapter. Except for a wire terminating device 55 thereof, all the remaining arrangement is the same as the first embodiment described above. The terminating wire device 55 without the connecting plate and wire locking bolt as that described in the first embodiment, has a contact point 55 on the outer side of a female element for making engagement with an orifice on the male element of another plug to be connected thereto. Of course, an opening 56 should be available at the rear end of the housing structure for receiving the male element of another plug. Besides, two through holes 57 are also provided at the rear end of the base 10 for inserting the wire ends therefrom and terminating on a V-shape notch 58 of the wire terminating device 55. By connecting the cover 19 to the base 10, the embodiment of this invention is completed.

While two preferred embodiments have been illustrated and described, it will be apparent that many changes may be made in the general construction and arrangement of the invention without departing from the spirit and scope thereof, and it is therefore desired that the invention be not limited to the exact disclosure but to the appending claims.

I claim:

1. A fuseless safety magnetic plug comprising:

a housing structure having a base with at least two electrical channels therein, a cover, and two prongs;

a pair of wire coupling devices mounted on the base;

a magnetic device connected respectively to each of said electrical channels on the base for protecting the plug from overloading by automatically breaking the circuit to open;

a current adjusting device matching with the magnetic device for setting different current load therein;

a cam mechanism matching with said magnetic device for circuit breaking; and a load discharging bolt matching with said cam mechanism for circuit re-connection after circuit breaking whereby said magnetic plug can effectively maintain the circuit connected thereto in safe condition, and be adaptable to different current requirements of various electrical appliances.

2. A safety magnetic plug as claimed in claim 1 wherein each of said wire coupling devices having a wire insertion base with an orifice on a cross member thereof, an plastical coupling plate with an orifice on a bent end thereof, and a wire locking bolt for making wire termination, is mounted on each electrical channel on the base, with the orifice of the coupling plate positioned over the orifice of the cross member of the wire insertion base so that when pressing down the wire locking bolt, the two orifices will be in the same axis for wire end insertion, and firmly holding the wire end in position when the wire locking bolt thereof is released.

3. A safety magnetic plug as claimed in claim 1 wherein said magnetic device further comprises:

a solenoid having two terminals for electrical connections and installed on the electrical channels of the housing base;

a magnetic device cover placed over the solenoid;

a magnetic plate having a lug on the inner edge thereof and movably coupled with the magnetic device cover, subjecting to the control of a magnetic force produced on the solenoid;

a movable plate in a fixing frame installed between the two electrical channels with both edges covered by the lug of the magnetic plate for breaking the circuit whereby said magnetic device is capable of automatically breaking the circuit when it is overloaded.

4. A safety magnetic plug as claimed in claim 1 wherein said current adjusting device comprises:

a lower adjusting knob having a slant surface on the bottom thereof with two stop blocks at both ends thereof;

an upper adjusting knob coupled with the lower adjusting knob with the head protruding over the surface of the cover;

a reverse spring with one end contacting the inner surface of the movable plate and the other end pressed under the slant surface of the lower adjusting knob whereby said current adjusting knob is capable of making current setting by adjusting the tension of the reverse spring under the lower adjusting knob.

5. A safety magnetic plug as claimed in claim 1 wherein said cam mechanism comprises:

a platinoid contacting pin secured on the base with a conductor connected to a terminal of the solenoid;

a spring plate with a protrusion at one end installed on the housing with the protrusion laid over the platinoid contacting pin;

two cams on both ends thereof and control wheel in the middle installed on the base with the two cams laid over the spring plates thereof; and a metal stud installed with one end on the middle surface of the control wheel and the other end loosely controlled by the movable plate whereby said cam mechanism can be effectively controlled by the magnetic device for breaking the circuit when it is overloaded.

* * * * *